US005615238A

United States Patent [19]

Wiencek et al.

[11] Patent Number: 5,615,238

[45] Date of Patent: Mar. 25, 1997

[54] METHOD FOR FABRICATING $^{99}$MO PRODUCTION TARGETS USING LOW ENRICHED URANIUM, $^{99}$MO PRODUCTION TARGETS COMPRISING LOW ENRICHED URANIUM

[75] Inventors: Thomas C. Wiencek, Orland Park; James E. Matos, Oak Park; Gerard L. Hofman, Downers Grove, all of Ill.

[73] Assignee: The United States of America as represented by the United States Department of Energy, Washington, D.C.

[21] Appl. No.: 464,420

[22] Filed: Jun. 5, 1995

Related U.S. Application Data

[62] Division of Ser. No. 130,485, Oct. 1, 1993, abandoned.

[51] Int. Cl.$^{6}$ ..... G21G 1/02; G21C 3/04

[52] U.S. Cl. ..... 376/202; 376/170; 376/186; 376/455; 29/17.3; 29/17.6; 29/890.041; 29/455.1; 29/506

[58] Field of Search ..... 376/202, 186, 376/414–416, 418, 432, 455, 170; 29/17.3, 17.4, 17.6, 890.041, 890.036, 455.1, 506, 508

[56] References Cited

U.S. PATENT DOCUMENTS

| | | | |
|---|---|---|---|
| 2,034,425 | 3/1936 | Allsworth . | |
| 2,967,139 | 1/1961 | Bartoszak | 376/455 |
| 3,004,907 | 10/1961 | Precht et al. | 376/455 |
| 3,384,551 | 5/1968 | Kornbichler | 376/455 |
| 3,422,523 | 1/1969 | Kling . | |
| 3,434,192 | 3/1969 | Ormerod | 29/411 |
| 3,728,220 | 4/1973 | Prince et al. | 376/455 |
| 3,928,132 | 12/1975 | Bujas . | |
| 3,955,093 | 5/1976 | Quinby | 376/202 |
| 4,751,044 | 6/1988 | Hwang et al. . | |
| 4,839,133 | 6/1989 | Vandegrift et al. | 376/202 |
| 4,876,780 | 10/1989 | Stahl et al. | 29/157.4 |
| 4,960,562 | 10/1990 | Okuda et al. . | |
| 5,056,209 | 10/1991 | Ohashi et al. . | |
| 5,079,824 | 1/1992 | Lopez et al. | 29/402.13 |

FOREIGN PATENT DOCUMENTS

| | | | |
|---|---|---|---|
| 1068832 | 12/1979 | Canada | 376/186 |

*Primary Examiner*—Harvey E. Behrend
*Attorney, Agent, or Firm*—Bradley W. Smith; Hugh W. Glenn; William R. Moser

[57] ABSTRACT

A radioisotope production target and a method for fabricating a radioisotope production target is provided, wherein the target comprises an inner cylinder, a foil of fissionable material circumferentially contacting the outer surface of the inner cylinder, and an outer hollow cylinder adapted to receive the substantially foil-covered inner cylinder and compress tightly against the foil to provide good mechanical contact therewith. The method for fabricating a primary target for the production of fission products comprises preparing a first substrate to receive a foil of fissionable material so as to allow for later removal of the foil from the first substrate, preparing a second substrate to receive the foil so as to allow for later removal of the foil from the second substrate; attaching the first substrate to the second substrate such that the foil is sandwiched between the first substrate and second substrate to prevent foil exposure to ambient atmosphere, and compressing the exposed surfaces of the first and second substrate to assure snug mechanical contact between the foil, the first substrate and the second substrate.

19 Claims, 1 Drawing Sheet

METHOD FOR FABRICATING $^{99}$MO PRODUCTION TARGETS USING LOW ENRICHED URANIUM, $^{99}$MO PRODUCTION TARGETS COMPRISING LOW ENRICHED URANIUM

CONTRACTUAL ORIGIN OF THE INVENTION

The United States Government has rights in this invention pursuant to Contract Number W-31-109-ENG-38 between the United States Government and Argonne National Laboratory.

This is a Division of application Ser. No. 08/130,485 filed Oct. 1, 1993, now abandoned.

BACKGROUND OF THE INVENTION

1. Field of the Invention

The present invention relates to a radioactive isotope production target and a method for fabricating a radioactive isotope production target and more specifically to a 99Mo production target and a method for fabricating a 99Mo production target using low enriched uranium. 2. Background of the Invention The use of radioactive isotopes is widespread, and includes applications in such diverse fields as industrial flow rate processes environmental investigations and medicine. These radioisotopes are produced primarily by bombarding highly enriched uranium (HEU), or $^{235}$U with neutrons to produce the daughters. While the demand for radioisotopes continues to increase, the use of HEU continues to be discouraged, primarily as HEU can be reprocessed for nuclear weaponry development. Since the United States desires to curtail the export of HEU, it is necessary to find a substitute target material.

One of the major isotopes used in medicine is Technetium-99m, primarily as this isotope has a short-lived half-life of approximately six hours. Technetium-99m for medical purposes is a decay product of $^{99}$Mo, which is produced in research reactors from the fissioning of $^{235}$U or from neutron capture in $^{98}$Mo to make the heavier $^{99}$Mo. $^{99}$Mo has a half-life of 66 hours.

$^{99}$Mo is produced using a variety of target designs that contain highly enriched uranium (HEU) of approximately 93 percent $^{235}$U. These designs include cladding shaped as plates, rods and cylinders with uranium material inserted therein Fuel plate designs utilize a sandwich configuration wherein the fissionable material in the form of a wire or a "meat" matrix resides between two plates of nonfissionable material, such as zirconium, aluminum, nickel, or alloys thereof. The advantage of these designs is efficient heat transfer throughout the target. A disadvantage of these plate designs is the need to dissolve the matrix with high volumes of solution to obtain the fission products. Such processes result in product being lost and/or further decaying prior to use. In addition, many plate designs require the use of highly enriched uranium.

Fuel rod designs (U.S. Pat. Nos. 3,799,883 and 3,940,318) eliminate those losses experienced when processing the products of HEU fission from plate configurations. Such HEU target rods comprise a hollow cylindrical can with a thin layer of $UO_2$ coated to the inside wall. Molybdenum recovery is accomplished by adding an acid solution into the target cylinder to dissolve the irradiated $UO_2$ from the cylinder wall for later processing. However, these rod configurations are limited in that they can accommodate only relatively thin layers of $UO_2$ coating, of approximately 0.001 inches. Such thicknesses can result in reasonable yields of $^{99}$Mo if HEU is employed as the fissionable material, but not if low enriched uranium (LEU) is used. Approximately five to six times the uranium must be processed and recovered for the same $^{99}$Mo yield obtained in HEU processes. However, increasing the thickness of LEU coatings in rod configurations does not work, as flaking of the material off the inside of the cylinder occurs at effective thicknesses beginning at approximately 0.002 inches.

A need exists in the an for a $^{99}$Mo target wherein said target exhibits good heat transfer, has low chemical processing requirements, and incorporates simple design configurations. Such a target must use only low enriched uranium as fissionable material.

SUMMARY OF THE INVENTION

It is an object of the present invention to provide a radioisotope production target and a method for producing same which overcomes many of the disadvantages of the prior art.

It is another object of the present invention to economically provide a relatively simple radioisotope production target. A feature of the invented product is the use of easily removable, low enriched fissionable material. An advantage of the invented product and process is the elimination of complicated fabrication processes and chemical processing steps, thereby affording developing nations the opportunity to produce radioisotopes.

Yet another object of the present invention is to provide a radioisotope production target without using high enriched uranium. A feature of the invention is using low enriched uranium as a fissionable material. An advantage of the invention is minimizing export and usage of high enriched uranium thereby maximizing both material handling safety and security against pro-nuclear weapon nations.

Still another object of the present invention is to provide a method for fabricating a radioisotope production target using fabrication techniques that do not require bonding the fissionable material with target cladding. A feature of the invention is using mechanical compression forces only to conjoin elements of the invention. An advantage of the invention is the elimination of processes heretofore necessary to separate fissionable materials from nonfissionable materials after irradiation.

Briefly, the invention provides for a radioisotope production target comprising an inner cylinder having an outer surface, a first end, and a second end, a foil of fissionable material circumferentially contacting the outer surface of the inner cylinder so as to substantially cover the outer surface of the inner cylinder, and an outer hollow cylinder having an inner surface, a first end, and a second end, said inner surface of the outer hollow cylinder adapted to receive the substantially foil covered inner cylinder and compress tightly against the foil to provide good mechanical contact therewith.

The invention also provides for a method for fabricating a primary target for the production of fission products comprising choosing a first substrate having a first substrate first surface, a first substrate second surface, a first substrate peripheral edge, and a first substrate predetermined thickness, preparing the first substrate first surface to receive a foil of fissionable material, said foil of fissionable material having a first foil surface, a second foil surface, and a predetermined thickness, contacting the foil first surface with the first substrate first surface so as to allow for later removal of the foil from the first substrate, choosing a second substrate having a second substrate first surface, a second substrate second surface, a second substrate peripheral edge, and a second substrate predetermined thickness, preparing the second substrate first surface to receive the foil second surface so as to allow for later removal of the foil from the second substrate; attaching the first substrate peripheral edge to the second substrate peripheral edge such that the first substrate second surface and the second substrate second surface are exposed to ambient atmosphere and the foil is sandwiched between the first substrate and second substrate to prevent foil exposure to ambient atmosphere, and compressing the exposed first substrate second surface and the second substrate second surface to assure snug mechanical contact between the foil and the first substrate first surface and between the foil and the second substrate first surface.

BRIEF DESCRIPTION OF THE DRAWING

The present invention together with the above and other objects and advantages may best be understood from the following detailed description of the embodiment of the invention illustrated in the drawings, wherein.

DETAILED DESCRIPTION OF THE INVENTION

Figure 1:
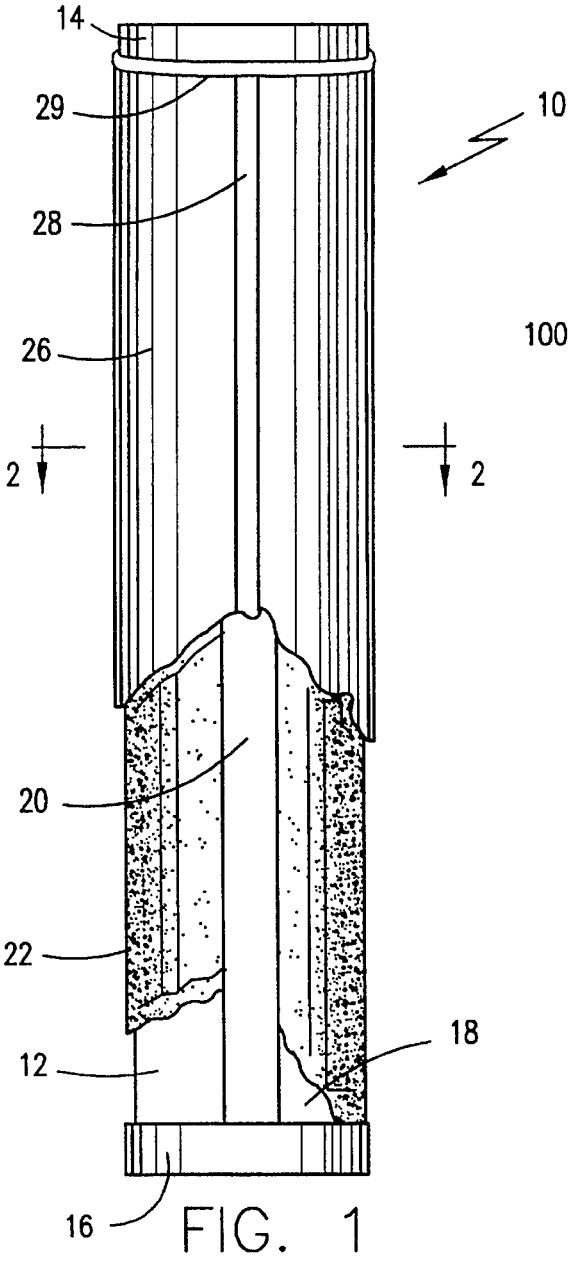
FIG. 1 is a partial cut-way view of a first embodiment of the invented target.

The present invention comprises three different designs. The first design, designated generally as 10 and partially depicted in an elevated view as FIG. 1, consists of an inner tube 12, a sheet or foil 22 of fissionable material wrapped around said inner tube 12, and an outer tube 26 in turn encircling the foil-wrapped hollow inner tube 12.

The inner tube 12 has a raised first end 14 and raised second end 16, each end raised to the same predetermined height relative to the surface of the inner tube 12, thereby effecting a relatively depressed center section 18. A narrow welding rib 20 integrally attached longitudinally to the inner tube 12 is further integrally attached to the first raised end 14 and second raised end 16. The depressed center section 18 is adapted to receive a sheet or foil of low enriched fissionable material 22 having a thickness ranging between approximately 0.025 millimeter and 0.25 millimeters, said thickness not to exceed the difference in the height of the raised ends 14, 16.

The sheet or foil 22 is generally rectangular and constructed so that two opposite sides of the foil 22, have a length equal to that of the depressed center section 18 of the inner tube 12. The sheet or foil 22 is further configured so that when it is wrapped circumferentially around the depressed center section 18, its remaining two opposite sides will abut against the raised rib 20. The foil 22 remains substantially in place once set into the depressed center section 18.

Figure 2:
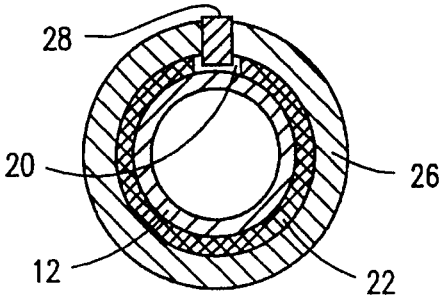
FIG. 2 is a cross sectional view of FIG. 1 taken along the line 2—2.

As depicted in FIG. 2, which is a cross sectional view of FIG. 1 taken along line 2—2, the first embodiment 10 further consists of an outer hollow tube 26 or sleeve, having a slit opening extending longitudinally the entire length of the tube 26. The outer hollow tube 26 is fitted tightly over the inner hollow tube 12 and foil 22 such that the split is positioned over the welding rib 20. The outer hollow tube 26 is then compressed against the foil to assure good mechanical contact and the edges of the slit of the tube 26 are then abutted together by a weld 28 or other suitable means. Compression can be done mechanically with hose-clamp devices. The ends of the outer hollow tube 26 are subsequently sealed by welds 29, or other suitable means, to the raised first end 14 and second end 16 so as to prevent foil exposure to ambient atmosphere when the target is cycled. Typically, welding is performed in an inert atmosphere, such as in a glove box permeated with nitrogen or argon.

Compression of the assembled target also can be effected hydraulically whereby the inner tube is plastically deformed just prior to welding the ends of the outer hollow tube 26 to the raised first end 14 and raised second end 16 of the inner hollow tube 12 to seal the tube. Any method of compression can be employed, so long as close mechanical contact between the inner hollow tube 12 and outer hollow tube 26 and the foil 22, as depicted in FIG. 2, is achieved to ensure good thermal conduction.

Figure 3:
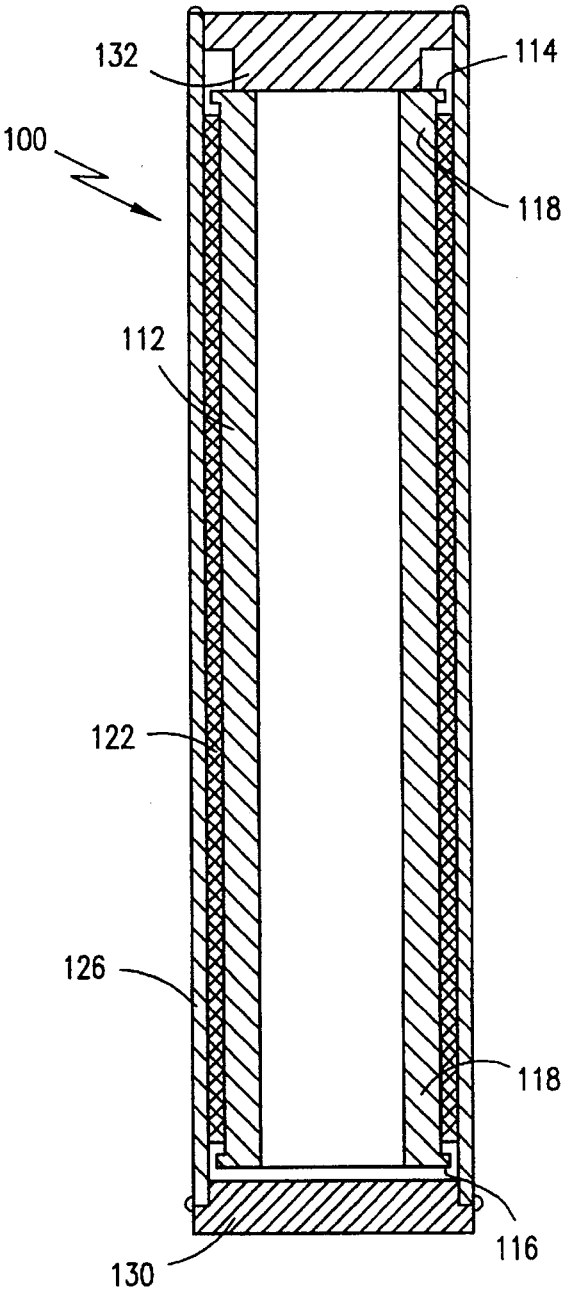
FIG. 3 is a longitudinal cross sectional view of a second embodiment of the invented target.

In a second embodiment of the invention, depicted as 100 in FIG. 3, a two-tube configuration is also used wherein an outer tube 126 slidably receives an inner tube 112.

As with the inner hollow tube 12 of the first embodiment 10, the inner tube 112 of this second embodiment 100 has a raised first end 114 and raised second end 116 so as to provide a depressed center section 118 to receive a sheet or foil of fissionable material 122. Said fissionable material is wrapped circumferentially around the inner tube 112, with the now wrapped inner tube then being inserted into the outer tube 126. Unlike the first embodiment 10, the outer tube 126 of the second embodiment 100 is not longitudinally split from end to end. Therefore, to assure good mechanical contact between the outside surface of the inner tube 112, the sheet or foil of fissionable material 122, and the inside surface of the outer tube 126, the two tubes are tapered to assure a snug fit.

Pressure is applied to further assure a tight fit in methods similar to those outlined above for the first embodiment 10. In one such process, the outer tube 126, is first closed at one end with a plug of similar metal 130. During compression, the top closure plug 132 is pressed down on the inner tube 112 and welded to the outer tube 126 under load to ensure maximum tightness in the assembly. The end plugs 130, 132, are received in a male-female fashion by the ends of the outer tube 126.

The mechanical bond between the foil 122 and the tubes is further enhanced when the temperature of the device increases during radiation, particularly when the material comprising the inner tube 112 is selected to have a higher coefficient of thermal expansion than the outer tube 126. For example, as aluminum has approximately a 2.5 fold higher coefficient of thermal expansion than zircaloy, any heating of an embodiment having an aluminum inner tube and a zircaloy outer tube will result in a tighter mechanical bond of the two tubes and the foil sandwiched between the tubes.

The target is disassembed by cutting off the top plug 132 and pulling out the inner tube 112 with the foil 122. The taper will assist in this operation.

In a third embodiment of the present invention the inside surface of an outer tube is lined with a sheet or foil of fissionable material. A first surface of the foil is held securely against the inside surface of the outer tube with a metal cylinder (solid, tubular or sectioned) that contacts and is mechanically expanded against a second surface of the foil. As with the previous two embodiments, the tight contact ensures that fission heat from the foil can be transferred through the tube wall to a coolant material.

Substrate Detail

A myriad of materials can be utilized as the substrate material for the above-described embodiments. For example, nonfissionable metal materials selected from the group consisting of steel, stainless steel, nickel, nickel alloy, zirconium, zircaloy, aluminum, or zinc coated aluminum can be employed. A variety of zircaloys are suitable, including, but not limited to reactor grade zirconium (UNS #R60001), Zirconium-tin alloy (UNS #R60802), Zirconium-tin alloy (UNS #R60804), and Zirconium-niobium alloy (UNS #R60901). A myriad of substrate shapes are also suitable, including cylinders, plates, spheres and ovals. When dealing with arcuate-shaped substrates, mechanical bonding between substrates and foil is enhanced when a first substrate having the usable convex surface has a higher coefficient of thermal expansion relative to the mating substrate having the concave surface. Upon cycling (and therefore, heating), the convex surface will expand against a first surface of the foil to enhance mechanical bonding. For example, the inventors have determined that with the thermal expansion coefficient of zircaloy of $6–10\times10^{-6}$, and the thermal expansion coefficient of aluminum at $25\times10^{-6}$, approximately 3 millimeters of interference occurs at 100° C. if the first substrate consists of aluminum and the second substrate consists of zircaloy.

The general dimensions of the target are limited only by reactor design. When working with cylinder-shaped targets, production runs typically require 18 inch lengths. Outer diameters of said cylindrical targets can vary from 2.5 cm to 5.8 cm (1 inch to 2 inches). For example, outer diameters of cylinders used by the inventors was approximately 3.8 cm. for aluminum and 3.2 cm for stainless steel. Cylinder wall thicknesses can vary, but generally range from approximately 0.025 to 0.060 inches. Generally, wall thicknesses are not critical, provided that proper heat conductance is achieved.

Preparation of the receiving surfaces of the substrates are crucial, as an advantage of the invention is easy removal of the irradiated foil from the target after cycling. Sticking of the foil, even after compression and cycling, is to be avoided. To avoid such diffusion bonding between the foil and the substrate surfaces, the receiving substrate surfaces are either anodized (to provide an oxide over the metal), or nitrided (whereby the substrate is first subjected to pack-nitriding and then fired).

The invented fabrication process and targets provide for target operation between the ranges of approximately 100° C. and 500° C.

Foil Detail

The method for fabricating the targets, and the targets themselves, utilize low enriched uranium metal or plutonium metal. An advantage of the invention is that a relatively low percent of the total weight of these metals is radioactive isotope. For example, low enriched uranium foil has approximately 19.8 percent $^{235}U$.

Foil thicknesses can vary, depending on the target configuration. Thicknesses can range from between approximately 0.001 inches to 0.01 inches. It is the design and fabrication of the invented targets that accommodates the heretofore restrictively high foil thicknesses of more than 0.002 inches, therefore providing an advantage over current state of the art.

A supplier for these foils is Marketing Services Corporation, Oak Ridge, Tenn.

While the invention has been described with reference to details of the illustrated embodiment, these details are not intended to limit the scope of the invention as defined in the appended claims.

The embodiment of the invention in which an exclusive property or privilege is claimed is defined as follows:

1. A method for fabricating a primary target for the production of fission products comprising:

a.) choosing a first substrate having a first substrate first surface, a first substrate second surface, a first substrate first end, a first substrate second end, a first substrate first raised shoulder at the first substrate first end, a first substrate second raised shoulder at the first substrate second end, and first substrate predetermined thickness;

b.) positioning a welding rib onto the first substrate first surface, said welding rib having a welding rib first side surface, a welding rib second side surface, and a welding rib top surface, where said welding rib extends longitudinally from the first substrate first raised shoulder to the first substrate second raised shoulder;

c.) sizing a foil of fissionable material, said foil having a foil first surface, a foil second surface, a foil first edged a foil second edge opposing the first edge, and a predetermined thickness;

d.) preparing the first substrate first surface to receive the foil first surface so as to avoid diffusion bonding between the first substrate surface and the foil first surface to allow for later removal of the foil from the first substrate;

e.) wrapping the foil around the first substrate such that the foil first surface is in contact with the first substrate first surface, the foil first edge abuts against the welding rib first side surface, and the foil second edge abuts against the welding rib second side surface;

f.) choosing a second substrate having a second substrate first surface, a second substrate second surface, a second substrate first end, a second substrate second end, a slit extending longitudinally from the second substrate first end to the second substrate second end, wherein the slit has opposing edges, and a second substrate predetermined thickness;

g.) preparing the second substrate first surface to receive the foil second surface so as to avoid diffusion bonding between the second substrate first surface and the foil second surface to allow for later removal of the foil from the second substrate;

h.) assembling the foil-wrapped first substrate and the second substrate such that the foil second surface contacts the second substrate first surface and the opposing edges of the second substrate slit are aligned over the welding rib top surface, whereby the first substrate second surface and the second substrate second surface are exposed to ambient atmosphere;

i.) mechanically compressing the second substrate to assure physical contact between all common surfaces of the first substrate, the foil, and the second substrate, to ensure good thermal conduction, whereby the opposing edges of the slit of the second substrate are moved into close proximity one to the other, and slit of the second substrate is aligned over the welding rib top surface;

j.) attaching the two opposing edges of the slit of the second substrate to the welding rib; and k.) attaching the second substrate first end to the first substrate first raised shoulder and the second substrate second end to the second surface raised shoulder.

2. The invention as recited in claim 1 wherein the raised shoulders on said first substrate are sized to a height which accommodates the foil thickness.

3. The invention as recited in claim 1 wherein the first and second substrates are nonfissionable metal materials selected from the group consisting of stainless steel, nickel, nickel alloys, zirconium, zircaloy, aluminum, or zinc coated aluminum.

4. The invention as recited in claim 1 wherein the foil of fissionable material consists of low enriched uranium metal or plutonium metal.

5. The invention as recited in claim 1 wherein the first substrate predetermined thickness is selected from a range of between approximately 0.025 inches and 0.060 inches, and the second substrate predetermined thickness is selected from a range of between approximately 0.025 inches and 0.060 inches.

6. The invention as recited in claim 5 wherein the predetermined thickness of the foil of fissionable material exceeds 0.05 millimeters.

7. A method for fabricating a primary target for the production of fission products comprising:

choosing a first substrate having a first substrate first surface, a first substrate first end, a first substrate first raised shoulder of a predetermined height integral to said first substrate first end, a first substrate second end, a first substrate second raised shoulder of a predetermined height integral to said first substrate second end, a first substrate second surface, a first substrate peripheral edge, a first substrate predetermined thickness, a depressed surface between said first substrate first raised shoulder and said first substrate second raised shoulder, and a longitudinal welding rib, having a predetermined height, a first side surface and a second side surface, integrally attached to the first substrate first surface, the first substrate first raised shoulder and the first substrate second raised shoulder;

preparing the first substrate first surface to receive a foil of fissionable material, said foil of fissionable material having a first foil surface, a second foil surface, a first side surface, a second side surface and a predetermined thickness;

circumferentially contacting the foil first surface with the depressed surface of the first substrate first surface, so as to allow for later removal of the foil from the first substrate;

abutting the first side surface and second side surface of said foil of fissionable material against the first side surface and second side surface of the longitudinal welding rib;

choosing a second substrate having a second substrate first surface, a second substrate second surface, a second substrate peripheral edge, a second substrate first end, a second substrate second end, a slit extending longitudinally the entire length of the second substrate from the second substrate first end to the second substrate second end, wherein the slit has opposing edges, and a second substrate predetermined thickness;

preparing the second substrate first surface to receive the foil second surface so as to allow for later removal of the foil from the second substrate;

attaching the first substrate peripheral edge to the second substrate peripheral edge such that the first substrate second surface and the second substrate second surface are exposed to ambient atmosphere, wherein the foil is sandwiched between the first substrate and second substrate to prevent foil exposure to ambient atmosphere and the opposing edges of said slit overlay the longitudinal welding rib of the first substrate;

compressing the exposed first substrate second surface and the second substrate second surface to assure physical contact between the foil and the first substrate first surface and between the foil and the second substrate first surface;

sizing the first substrate raised shoulders so that the predetermined heights of the first substrate first raised shoulder and the first substrate second raised shoulder are of the same height relative to the first substrate first surface, thereby creating a depressed center section coextensive with the depressed surface of said first substrate;

sizing the welding rib so that the predetermined height of the welding rib is commensurate with the predetermined thickness of the foil of fissionable material, wherein said foil abuts against the first and second side surfaces of said welding rib to retain the foil within the depressed center section;

welding the opposing edges of the slit of said second substrate to the rib of said first substrate.

8. The invention as recited in claim 1 wherein the steps of preparing the first substrate first surface and the second substrate first surface consist of chemically treating the first substrate first surface and the second substrate first surface to avoid chemical bonding of the foil to the first substrate first surface and the second substrate first surface.

9. A primary target for the production of fission products, comprising:

a.) an inner cylinder having an interior surface, an exterior surface, a first end, a second end, a first raised shoulder at the first end, and a second raised shoulder at the second end;

b.) a raised welding rib forming an integral part of said inner cylinder and extending longitudinally from the first raised shoulder to the second raised shoulder, said welding rib having a top surface, a first side surface, and a second side surface;

c.) a foil of fissionable material having a first surface, a second surface, a first edge, and a second edge which opposes the first edge, wherein the length from the first edge to the second edge is less than the circumference of the inner cylinder exterior surface, and whereby said foil forms a layer on the inner cylinder exterior surface so that the foil first surface contacts the inner cylinder exterior surface, the foil first edge abuts against the welding rib first side surface, and the foil second edge abuts against the welding rib second side surface;

d.) an outer cylinder having an interior surface, an exterior surface, a first end, a second end, and a slit extending longitudinally from the outer cylinder first end to the outer cylinder second end, the slit having a first edge and a second edge, whereby the outer cylinder forms a layer on the foil such that the outer cylinder interior surface contacts the foil second surface, the outer cylinder first end contacts the inner cylinder first raised shoulder, the outer cylinder second end contacts the inner cylinder second raised shoulder, and the slit first edge and the slit second edge are aligned over the welding rib top surface;

e.) first means for attaching the outer cylinder slit edges to the welding rib top surface;

f.) second means for attaching the outer cylinder first end to the inner cylinder first raised shoulder and the outer cylinder second end to the inner cylinder second raised shoulder, whereby said foil is contained between the inner and outer cylinders.

10. A primary target as recited in claim 9, wherein the inner cylinder first and second raised shoulders are raised to a height which accommodates the predetermined thickness of foil.

11. A primary target as recited in claim 9, wherein the foil has a thickness selected in the range of between 0.05 millimeters and 0.25 millimeters.

12. A primary target as recited in claim 9, wherein the foil consists of low enriched uranium metal or plutonium metal.

13. A primary target as recited in claim 9, wherein said inner cylinder and said outer cylinder have a thickness selected from the range of between approximately 0.025 inches and 0.060 inches.

14. A primary target as recited in claim 9, wherein said inner cylinder and said outer cylinder are nonfissionable metal materials selected from the group consisting of stainless steel, nickel, nickel alloys, zirconium, zircaloy, aluminum, or zinc coated aluminum.

15. A primary target as recited in claim 9, wherein said inner cylinder exterior surface and said outer cylinder interior surface are chemically prepared so as to avoid bonding between the cylinder surfaces and the foil to allow for later removal of the foil.

16. A primary target as recited in claim 15, wherein the chemical preparation consists of anodizing or nitriding.

17. A primary target as recited in claim 9, wherein said first means for attaching is a single unifying weld.

18. A primary target as recited in claim 9, wherein said second means for attaching is a weld.

19. The invention as recited in claim 8 wherein said chemically treating the first substrate first surface and the second substrate first surface to minimize chemical bonding of the foil comprise the process of anodizing or nitrating said first substrate first surface and second substrate first surface.

* * * * *